US011046070B2

(12) United States Patent
Walter

(10) Patent No.: US 11,046,070 B2
(45) Date of Patent: Jun. 29, 2021

(54) PROCESSING MACHINE COMPRISING A RADIATION DRYER AND METHOD FOR OPERATING SAID DRYER

(71) Applicant: KOENIG & BAUER AG, Würzburg (DE)

(72) Inventor: Maik Walter, Dresden (DE)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 16/970,395

(22) PCT Filed: Apr. 16, 2019

(86) PCT No.: PCT/EP2019/059858
§ 371 (c)(1),
(2) Date: Aug. 17, 2020

(87) PCT Pub. No.: WO2019/201960
PCT Pub. Date: Oct. 24, 2019

(65) Prior Publication Data

US 2021/0001621 A1 Jan. 7, 2021

(30) Foreign Application Priority Data

Apr. 20, 2018 (DE) ..... 10 2018 206 154.8

(51) Int. Cl.
*B41F 23/04* (2006.01)

(52) U.S. Cl.
CPC ..... *B41F 23/0453* (2013.01); *B41F 23/0409* (2013.01); *B41F 23/0483* (2013.01)

(58) Field of Classification Search
CPC ..... B41F 23/0453
(Continued)

(56) References Cited

U.S. PATENT DOCUMENTS 4,809,608 A * 3/1989 Wolnick ..... B41F 23/0443 101/416.1
4,882,992 A * 11/1989 Schmoeger ..... B41F 23/0443 101/424.1

(Continued)

FOREIGN PATENT DOCUMENTS

DE 19516053 A1 11/1996
DE 69413439 T2 3/1999

(Continued)

OTHER PUBLICATIONS

International Search Report of PCT/EP2019/059858 dated Aug. 2, 2019.

*Primary Examiner* — Anthony H Nguyen
(74) *Attorney, Agent, or Firm* — Mattingly & Malur, PC

(57) ABSTRACT

A processing machine includes a dryer device. In particular, the processing machine is a printable material- or sheet-processing or a substrate-processing machine, in particular a printing machine. A method for operating a drying device in such a processing machine is also provided. The processing machine addresses the problem of creating an alternative processing machine comprising a drying device or an alternative method for operating a drying device in a processing machine. In particular, the cooling in preferably high-performs dryers in processing machines, such as substrate, or printable material-processing machines, should be improved. Especially preferably the cooling of the underside of the underside of a UV emitter should also be further improved. The problem is solved by pairing a blast air system with the drying device, by the use of which blast air system, the ambient air flowing into the air inlet opening can be or is actively influenced at a distance from the radiation source.

13 Claims, 9 Drawing Sheets

(58) Field of Classification Search
USPC ..... 101/424.1
See application file for complete search history.

(56) References Cited

U.S. PATENT DOCUMENTS

| | | | | |
|---|---|---|---|---|
| 4,983,852 | A * | 1/1991 | Burgio, Jr. | B41F 23/0409 250/504 R |
| 5,003,185 | A * | 3/1991 | Burgio, Jr. | B41F 23/0409 250/494.1 |
| 5,489,819 | A | 2/1996 | Sakai et al. | |
| 5,751,008 | A | 5/1998 | Jung et al. | |
| 6,807,906 | B1 | 10/2004 | DeMorre et al. | |
| 7,002,170 | B2 | 2/2006 | Schweitzer | |
| 9,370,941 | B2 | 6/2016 | Rae et al. | |
| 9,873,267 | B2 | 1/2018 | Rae et al. | |
| 2004/0149936 | A1 | 8/2004 | Schweitzer | |
| 2007/0214986 | A1* | 9/2007 | Gaus | B41F 23/0409 101/416.1 |
| 2008/0143806 | A1* | 6/2008 | Claeys | F26B 3/28 347/102 |
| 2014/0292970 | A1 | 10/2014 | Rae et al. | |
| 2016/0200119 | A1* | 7/2016 | Rae | B41J 11/00214 250/372 |
| 2018/0222178 | A1* | 8/2018 | Boland | B41F 23/0436 |

FOREIGN PATENT DOCUMENTS

| | | | |
|---|---|---|---|
| DE | 10125770 | A1 | 12/2002 |
| DE | 10247464 | A1 | 4/2004 |
| DE | 102008058056 | A1 | 7/2010 |
| DE | 102010009520 | A1 | 9/2011 |
| EP | 0616357 | A1 | 9/1994 |
| EP | 1625016 | B1 | 10/2008 |
| EP | 2404757 | A1 | 1/2012 |
| EP | 2697066 | B1 | 12/2014 |
| EP | 3045319 | A1 | 7/2016 |
| EP | 3168861 | A1 | 5/2017 |
| FR | 2774156 | A1 | 7/1999 |
| JP | 4132940 | U | 12/1992 |
| JP | 2000157925 | A | 6/2000 |
| JP | 2014042884 | A | 3/2014 |
| KR | 20100008087 | A | 1/2010 |

* cited by examiner

PROCESSING MACHINE COMPRISING A RADIATION DRYER AND METHOD FOR OPERATING SAID DRYER

CROSS REFERENCE TO RELATED APPLICATIONS

This application is the U.S. National Phase, under 35 U.S.C. § 371, of PCT/EP2019/059858, filed Apr. 16, 2019; published as WO 2019/201960 A1 on Oct. 24, 2019, and claiming priority to DE 10 2018 206 154.8, filed Apr. 20, 2018, the disclosures of which are incorporated herein in their entireties by reference.

FIELD OF THE INVENTION

The present invention relates to a processing machine having a drying device, in particular a machine for processing printing material or sheets or for processing substrate, specifically a printing press, and to a method for operating a drying device in a processing machine.

BACKGROUND OF THE INVENTION

High-performance drying devices comprising radiation dryers, in particular, are typically cooled. UV emitters installed in a UV module, for example, in printing material processing machines, for example sheet-fed printing presses, are cooled especially during operation. UV emitters operating at higher outputs must also be cooled to prevent them from reaching the transformation temperature of the glass tube, causing the tube to become deflected or even to blow out.

Exhaust air cooling systems for cooling UV emitters are known. In such systems, ambient air flows through an air inlet opening in the housing past the UV emitter, with the air inlet opening also acting at the same time as the radiation outlet opening. The disadvantage of such systems is that, due to its structural configuration, the UV emitter is cooled primarily on its upper side. The underside is generally much hotter because there is insufficient convection there. Heat on the underside is dissipated by the radiation and conduction of heat in the glass tube toward the well-cooled upper side.

From DE 694 13 439 T2 and EP 1 625 016 B1, it is known to use supply air from the air duct of the housing profile to blow air at a UV emitter. This supply air cooling is significantly more effective than exhaust air cooling and substantially reduces the glass tube temperature on the upper side of the UV emitter.

However, its influence on the temperature on the underside of the glass tube is insufficient, since the conduction of heat in the glass tube from the underside to the upper side is limited.

From DE 101 25 770 A1, an irradiation device is known, in which the radiation source is arranged, rotatable about its longitudinal axis, in conjunction with a supply air cooling system in the irradiation device. The disadvantage of this solution is that it functions using a supply air cooling system and comprises moving parts that are susceptible to malfunction, and is therefore complex and inefficient.

From JP 4-132940 U, KR 10-1031749 B1, EP 2 697 066 B1, JP 2014-42884 A and EP 3 168 861 A1 it is known to use a plate to encapsulate drying devices against ambient air, with various airflow routes being implemented in the housing. The disadvantage of these solutions is that a large flow volume of ambient air flowing around the radiation source is not achieved. In addition, an effective extraction of ambient air contaminated with ozone is not provided.

From DE 10 2008 058 056 A1 a UV irradiation device is known, in which a first cooling air flow is drawn into the sides of the housing via air inlet openings in the outer wall in order to cool the bulkhead system from the outside. The cooling air is conducted along the housing wall into a central exhaust duct and from there travels to a blower via a manifold, which forces the entire cooling air flow to the UV irradiation device. A second cooling air flow is captured in the region of the radiation source by a long-necked suction duct and is conducted via a restrictor into the manifold. The disadvantage of this solution is that this exhaust air cooling system does not adequately cool the underside of the radiation source.

From FR 2 774 156 A1, a device is known for accelerating drying by means of an infrared emitter that generates heat. In said device, an air generation system supplies low temperature air to reduce the temperature within the housing.

DE 102 47 464 A1 discloses a dryer device having an infrared emitter, with an after-dryer module situated downstream of a main dryer module. The dryer device is sealed off from the cold ambient air by a bulkhead.

From JP 2000-157925 A, an ultraviolet curing device with a UV radiation tube is known. For cooling, the distance between the reflectors and the emitter over the length of the emitter is adjusted. Additionally, an air duct is used, which directs cooling air directly onto the emitter. The cooling air expelled from the air duct is configured such that it increases in volume as it moves further away from an exhaust side.

SUMMARY OF THE INVENTION

The object of the present invention is to create an alternative processing machine having a drying device or an alternative method for operating a drying device in a processing machine. In particular, the object is to improve the cooling of preferably high-performance dryers in processing machines, such as machines for processing substrate or printing material. Particularly preferably, the object is to further improve the cooling of a UV emitter, including on the underside thereof.

The object is achieved according to the invention by the provision of a processing machine having a drying device which comprises a radiation source accommodated in a housing. Shutters are provided adjacent to the radiation source in the housing. The housing has at least one air inlet opening for ambient air so that, once the ambient air has entered the housing, it flows around the radiation source. The housing also has an air outlet opening for exhaust air. A blower air system is associated with the drying device and by which blower air system, ambient air flowing into the air inlet opening is or can be actively influenced at a distance from the radiation source. A method is also provided for operating the drying device in the processing machine. The blower air system, which is associated with the drying device, actively influences or deflects the ambient air flowing into the air inlet opening before it reaches the radiation source.

The invention offers the advantage that an alternative processing machine having a drying device or an alternative method for operating a drying device in a processing machine is created. In particular, the cooling of preferably high-performance dryers in processing machines, such as machines for processing substrate or printing material, in particular printing presses or sheet-processing machines, is improved. Particularly preferably, the cooling of the underside of a UV emitter is further improved.

The drying device is preferably used in a sheet-processing or substrate-processing machine, especially a printing press, or such a machine is equipped with one or more such drying devices. Preferably, the drying device can also optionally be used as an interdeck dryer or as an end-of-press dryer, for example in a delivery. Tabular substrate, for example metal sheets, can be processed as the substrate. However, material in rolled format or sheet format can also be processed, in particular printed or coated.

Exhaust air cooling has the particular advantage that ozone generated by UV radiation is extracted at the same time from the drying device, for example a UV module. Ozone presents a health hazard to humans; moreover, ozone absorbs UV radiation and thus diminishes the curing effect of the drying device, in particular the UV module. A blower air system improves the airflow guidance in the preferred exhaust air cooling system.

The ambient air, in particular the ambient air located outside of the drying device or in contact with a printing material, is preferably guided in a targeted manner by additional directed air and/or blower air in such a way that both the ambient air and the additional air or blower air are optimally guided as cooling air around the radiation source, after which the common cooling air is removed, in particular extracted, as exhaust air through one or more air outlet openings.

In addition, the underside of the radiation source can be cooled directly and/or indirectly by air streams, for example blower air streams or blower air jets, which are introduced on one side or preferably on both sides, with the additional air, for example blower air, being introduced or blown in, in particular, beyond the irradiation range of a UV module. With the preferable introduction or blowing in of air on both sides, the two streams can meet, for example, at the center below the UV module or beneath the radiation source. Alternatively or additionally, part of the air can be blown at the radiation source, in particular a UV emitter, directly from below. Preferably, however, blower air is guided parallel to or within the plane of the air inlet opening of the housing, so that the blower device does not lie within the beam path of the radiation from the radiation source. Thus, the blower air is preferably generated at least approximately parallel to the web of processing material or to a printing material web.

In particular, constricting the ambient air improves or optimizes the transport thereof as cooling air in the drying device, in particular in the UV module, to the underside of the radiation source, thereby better cooling the underside thereof. In addition, cooling advantageously becomes more turbulent and, surprisingly, the upper side of the radiation source is also better cooled, as has been evidenced in studies, specifically on the basis of temperature measurements.

The additional air or blower air is introduced or blown in, for example, over the entire length of a drying device, for example the UV module, or the radiation source. This can be accomplished using air guide elements, such as baffles, and/or blower air openings, in particular nozzles. The air introduced or blown in on both sides, for example, can be either part of or at least approximately all of the cooling air discharged in the UV module. The air flow volume of the air additionally introduced or blown in by the blower air system can preferably be between 20% and 50% of the total cooling air flow volume. Accordingly, the proportion of inflowing ambient air can be between 80% and 50%. The goal, in particular, is a ratio of approximately 1/3 air additionally introduced or blown in by the blower air system and approximately 2/3 incoming ambient air.

The radiation sources, in particular UV emitters, can thus particularly advantageously be operated at an even higher output or the air flow volume can be reduced while the same level of cooling is maintained. As a further advantage, a deflection or blow-out of a UV emitter can be more reliably prevented.

It can further be provided to configure the blower air system as an add-on module or auxiliary module, which can be embodied as detachably or permanently connectable in particular to a UV module of a dryer. Such a blower air system can be configured to be added on to any UV module of a dryer. Said add-on module in particular comprises separate air guiding elements or air ducts, which are provided for influencing or adjusting the ambient air flow volume flowing around the radiation source. An add-on module or auxiliary module can easily be used for retrofitting dryers. Further, a plate spaced a distance from the housing of the UV module could also be additionally provided in the beam path of the radiation source, as long as a sufficient air flow volume flowing into at least one air inlet opening is ensured.

BRIEF DESCRIPTION OF THE DRAWINGS

In the following, the invention will be explained in detail by way of example. The accompanying drawings schematically depict the following.

DESCRIPTION OF THE PREFERRED EMBODIMENT

In processing machines such as printing material processing machines, in particular printing presses or sheet processing machines, for example sheet-fed printing presses, in particular sheet-fed rotary offset printing presses, preferably in unit-based and inline configuration, substrates or printing materials are conveyed through the machine. In sheet processing machines, sheets of printing material, for example, are gripped at the leading edge by cylinders or by drums and are conveyed or transported through the machine as the cylinders rotate. The sheets of printing material are transferred between the cylinders in the gripper closure. In printing presses, the printing materials pass through various printing units along the conveying path, in each of which the materials are printed with a respective printing ink in accordance with the desired motif. Each of the printing units may comprise, for example, a plate cylinder, which is inked up by means of an inking unit with the printing ink to be used. This inked-up plate cylinder transfers the printing ink, in accordance with the motif, onto a blanket cylinder furnished with a rubber printing blanket, which cylinder forms a printing nip with a printing cylinder of a sheet-fed printing press, which printing cylinder conveys the sheet of printing material. As it passes through the printing nip, the corresponding motif is transferred from the inked-up rubber printing blanket of the blanket cylinder onto the sheet of printing material.

Downstream of the last printing unit of the printing press, the printed sheets of printing material can be delivered in a delivery of a sheet-fed printing press to form a delivery pile. The last printing unit can also be followed, for example, by one or more coating units, which furnish the printed sheets of printing material with a protective coating or gloss coating. UV inks are preferably used in the printing units and UV coatings are preferably used in the coating units. For recto-verso printing, a printing press may include a turning device. Alternatively, however, other printing methods, for example with variable motifs, can also be used. A drying device or an interdeck dryer in the machine is embodied, in particular, as a UV drying device and comprises one or more UV modules 1, for example.

Figure 1:
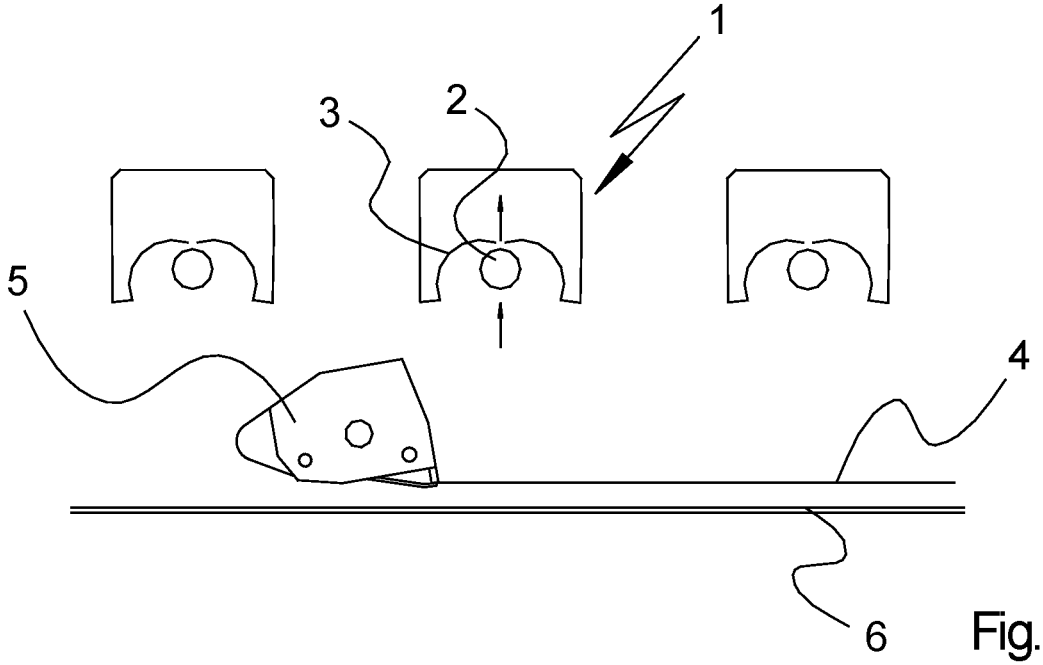
FIG. 1: a section of a delivery of a sheet processing machine having a dryer comprising three UV modules, arranged above a sheet conveying path.

FIG. 1 shows, for example, part of a delivery of a sheet-fed printing press having a drying device arranged above a sheet conveying path, in particular having a dryer that comprises a plurality of UV modules 1. The drying device can also comprise hot air dryers, among other components. In the delivery (not depicted), gripper carriages 5 are provided, which are arranged on chains by which they are driven in an endlessly circulating fashion; said carriages receive the processed sheets 4 at the leading edge thereof from the last cylinder and convey them along the sheet conveying path to the delivery pile. The UV modules 1 are arranged, in particular, at a fixed distance from the sheet conveying path so that the circulating gripper carriages 5 can move unimpeded. As the sheets 4 are conveyed or transported through the delivery, they can be guided over sheet guide plates 6, and an air cushion can be formed between the sheets 4 and the sheet guide plates 6. Alternatively, the UV modules 1 can also be arranged in the ascending branch of the circulating chains and/or in a delivery extension. Alternatively or additionally, a drying device can also be arranged below the sheet conveying path.

On the path to the delivery pile, the sheets 4 are guided past the UV modules 1 that dry or cure the sheets 4. The UV modules 1 each have UV emitters 2, the UV radiation of which is directed directly or via reflectors 3 onto the surface of the sheets 4. This UV radiation acting on the sheets 4 dries or cures the treated sheet surface, in particular the printed UV ink and/or the applied UV coating. Preferably, mercury vapor lamps are used as radiation sources in the UV modules 1. Additionally or alternatively, emitters with other wavelengths, such as infrared dryers, for example, can also be used. For example, plug-in slots can be provided in the machine or the delivery, into which the UV modules 1 can be inserted. The UV modules 1 can be fixed in these plug-in slots, thereby ensuring that the UV modules 1 can be replaced, e.g. if the UV emitter 2 becomes worn. The UV modules 1 operate in particular with exhaust air cooling.

Figure 2:
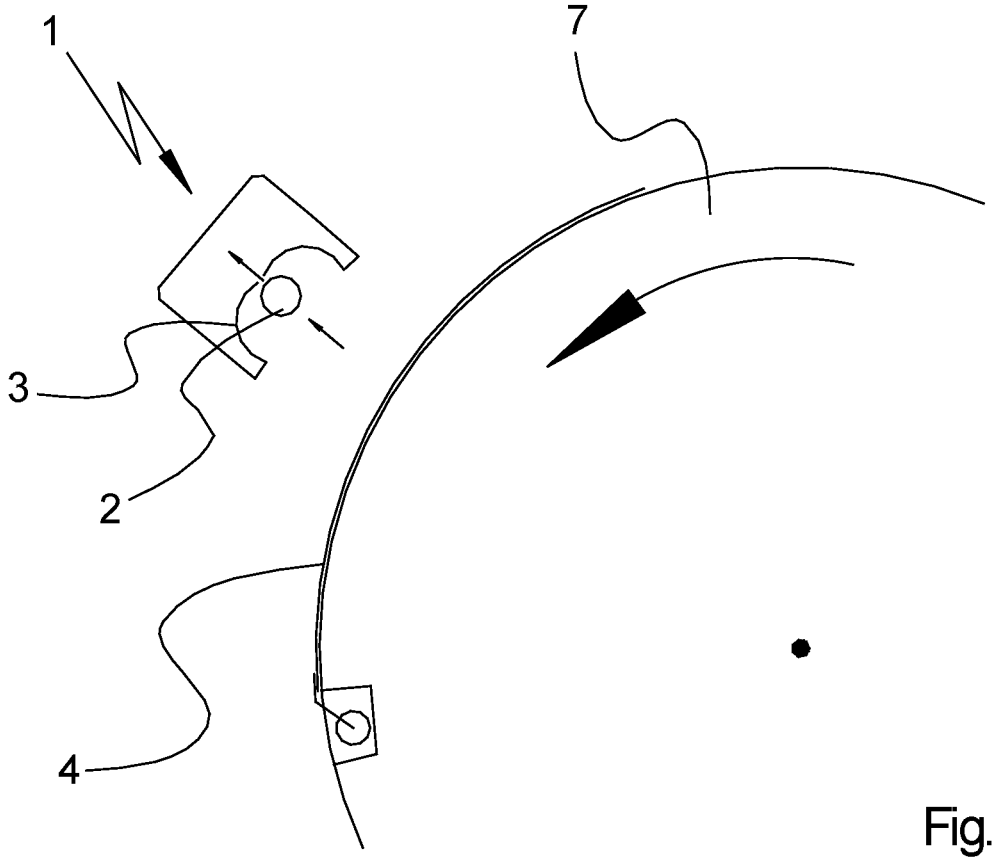
FIG. 2: a sheet guiding cylinder with a UV module arranged as an interdeck dryer.

FIG. 2 shows a drying device, in particular a UV module 1, at a sheet guiding cylinder 7 of a sheet processing machine, for example the sheet-fed printing press described above. The UV module 1 is assigned in particular as an interdeck dryer to the sheet guiding cylinder 7 of a unit. The sheet guiding cylinder 7 preferably includes gripper systems, which are configured here in particular as clamping grippers with gripper fingers and gripper striking surfaces. The gripper fingers fix the sheet leading edge on the gripper striking surfaces by a gripping movement, so that the sheet 4 is secured for transport on the lateral surface of the sheet guiding cylinder 7 rotating in the direction shown. The UV module 1 may be arranged in a printing, coating, drying, or processing unit, etc. of the machine. As an interdeck dryer, the UV module 1 can be used in particular between printing units of the machine for drying one or more inks or coatings, in particular UV inks or UV coatings. The interdeck dryer can also be embodied for insertion into a plug-in slot of the machine, and thus as replaceable. In that case, the UV modules 1 can be interchangeable between the plug-in slots of the interdeck dryer and the delivery. The UV module 1 embodied as an interdeck dryer operates, in particular, with exhaust air cooling.

Figure 3:
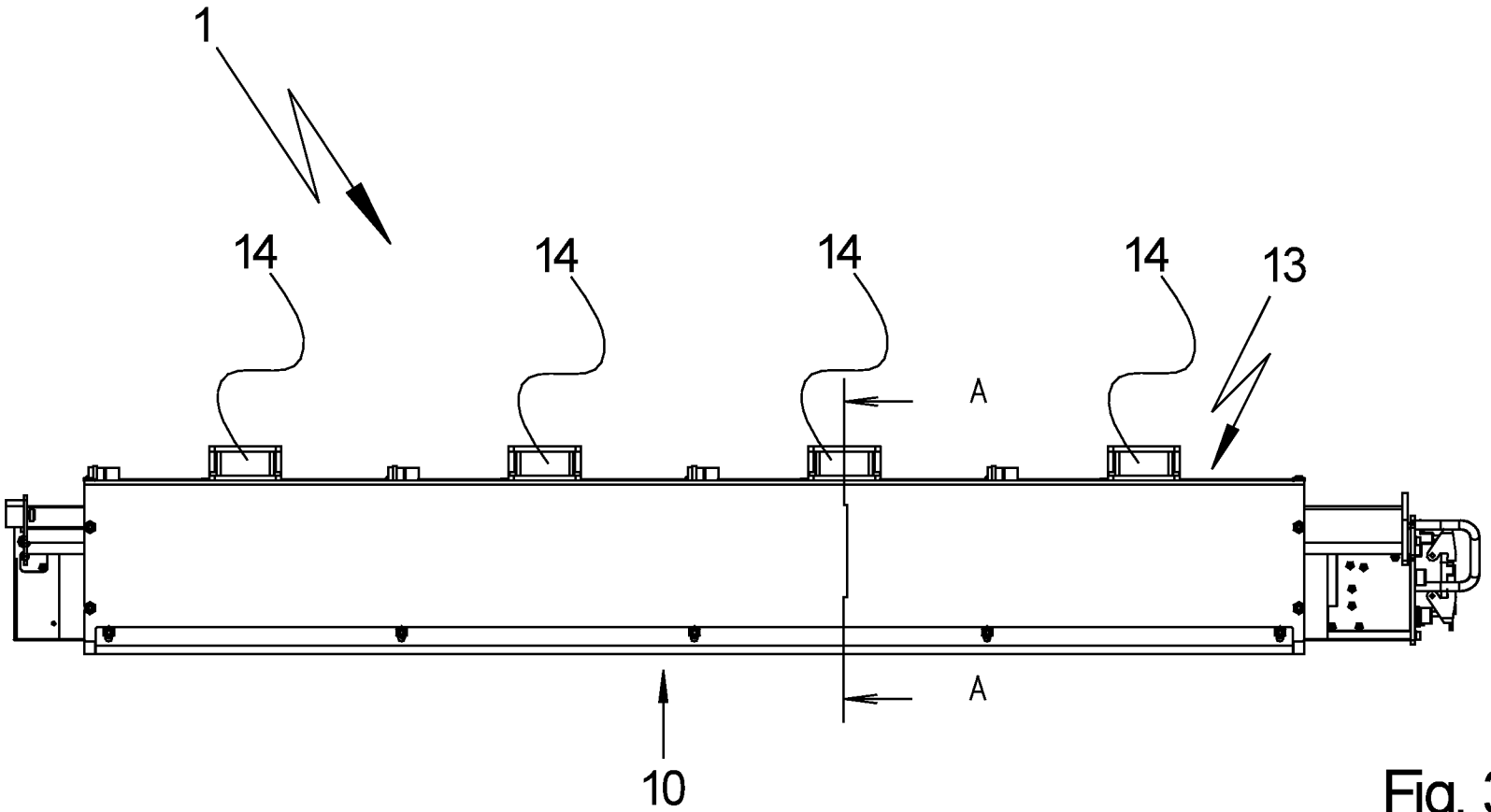
FIG. 3: a UV module of a dryer having a longitudinally extending UV emitter and an associated blower air system.

FIG. 3 shows a UV module 1, which accommodates a longitudinally extending UV radiation source, in particular a gas discharge tube filled with mercury vapor, transversely to the conveying direction of the processing material, for example the printing material or sheet 4. The UV module 1 can be assigned to a plug-in slot of the machine, for example, which preferably also has electric or pneumatic supply connections. The corresponding electric or pneumatic connections can be provided, for example, in the plug-in slot. A blower air system 13 is assigned to the UV module 1 and extends, in particular, over the maximum material width to be processed by the machine, for example the printing material width. The blower air system 13 has an overpressure supply, which includes, for example, an overpressure connection or preferably overpressure generators. The overpressure generators may be embodied, for example, as fans, in particular as axial fans 14, preferably distributed over the width of the printing material. Electric power can be supplied to fans, in particular axial fans 14, separately or jointly with the UV module 1. On the side facing the processing material or printing material, the UV module 1 has an air inlet opening 10 for the ambient air, i.e. the air that comes into contact with the substrate or printing material or that is located in the beam path of the UV module 1. Here, the air inlet opening 10 acts in particular simultaneously as the radiation outlet opening of the UV emitter 2 of the UV module 1.

Figure 4:
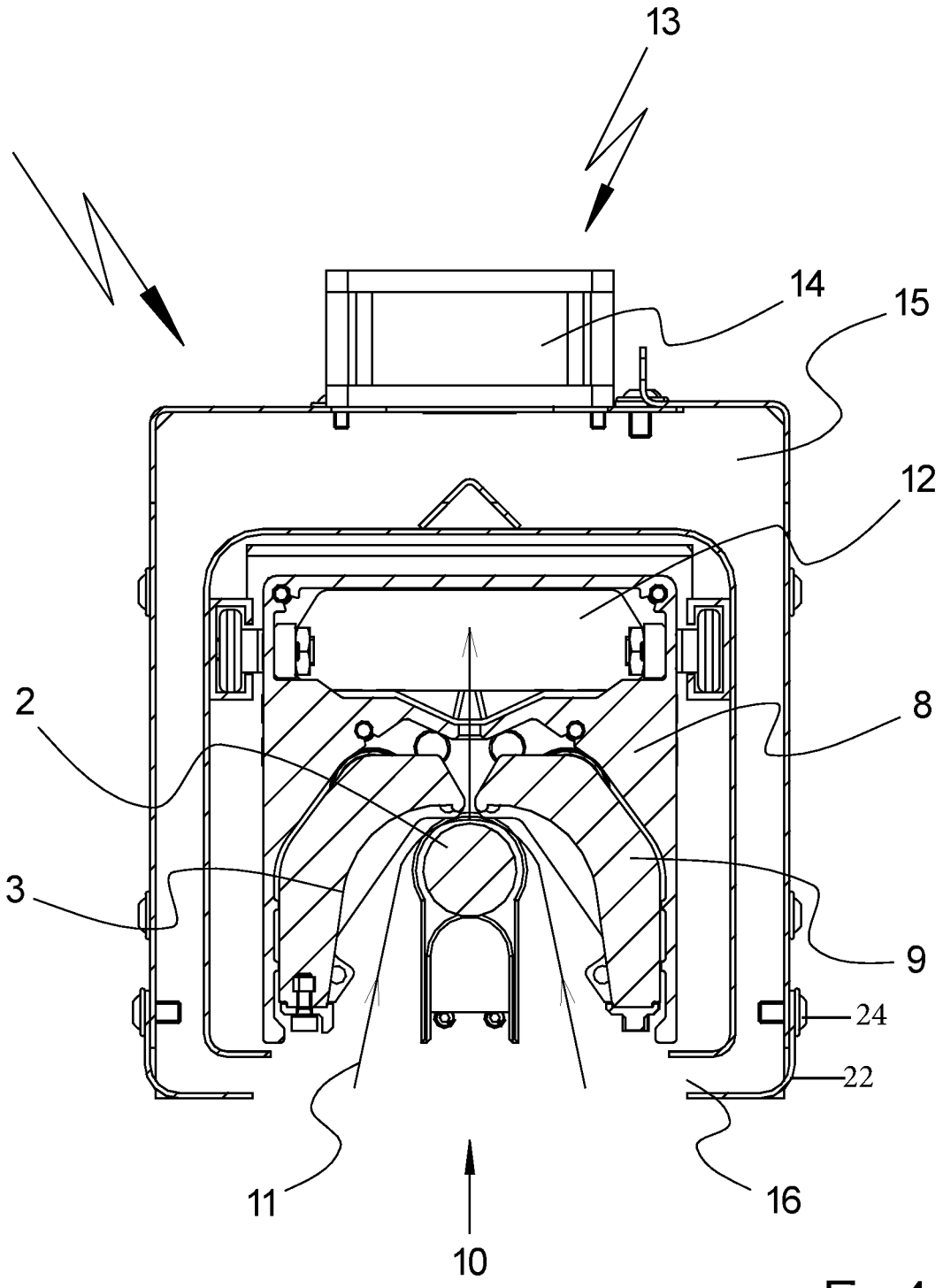
FIG. 4: a cross section of the UV module with the blower air system deactivated.

FIG. 4 shows the cross section of the UV module 1 according to section A-A of the preceding figure with the blower air system 13 deactivated. The UV module 1 can have a housing profile 8, in particular, in which an exhaust air duct 12 is preferably arranged. An extrusion profile of the UV module 1 can typically be made of aluminum, for example. The reflectors 3 installed in known shutters 9 reflect the radiation from the UV emitter 2 to the substrate or printing material. For this purpose, the shutters 9 are preferably provided along the UV emitter 2 in the housing profile 8. The shutters 9 are preferably embodied as movable and/or liquid-cooled. The shutters 9 preferably each have, for example, an axis of rotation about which the shutters 9 can move, arranged parallel to the extension of the UV emitter 2. When the shutters 9 are displaced, preferably jointly, the air inlet opening 10 of the housing profile 8 is especially closed. During operation, the shutters 9 are correspondingly held in a position that opens the air inlet opening 10.

The ambient air, which is drawn in between the shutters 9 or reflectors 3 and the UV emitter 2, flows through the air inlet opening 10 that faces the substrate or printing material and thereby cools the UV emitter 2. The cooling air then flows out between the shutters 9 into the exhaust air duct 12 of the housing profile 8. For this purpose, the exhaust air duct 12 is preferably connected on one side to a suction air source that can be controlled or regulated, for example, which draws the exhaust air into the exhaust air duct 12. The exhaust air duct 12 preferably extends over the entire length of the UV emitter 2, so that the air heated at the UV emitter 2 can be drawn off into the exhaust air duct 12 through distributed openings. It can be provided, for example, that the exhaust air duct 12, which extends along the radiation source, in particular the UV emitter 2, can be connected to the space surrounding the UV emitter 2 via oblong holes that are spaced apart from one another. Said oblong holes are preferably dimensioned such that they differ from one another in terms of their aperture areas. In particular, the aperture areas of the oblong holes between the ends of an elongated UV emitter 2 are smaller in dimension than the oblong holes provided at the respective ends of the UV emitter 2. Very preferably, the aperture areas of the oblong holes between the ends of the elongated UV emitter 2 are dimensioned as steadily decreasing in size, in particular without local maxima, toward the suction air source of the exhaust air duct 12. More preferably, the aperture areas of the oblong holes associated with the ends of the elongated UV emitter 2 are dimensioned differently from one another, with the aperture area of at least one oblong hole at the end of the UV emitter 2 that faces the suction air source of the exhaust air duct 12 preferably having smaller dimensions than the aperture area of at least one oblong hole at the end of the UV emitter 2 that faces away from the suction air source of the exhaust air duct 12. The oblong holes that face the respective ends of the UV emitter 2 can also comprise two, three, or four oblong holes.

The air flows that result during operation with exhaust air cooling activated and with the blower air system 13 deactivated are depicted here generally or schematically. Cooling occurs above all on the upper side of the UV emitter 2, while the underside directed toward the processing material is cooled less than the upper side. Warming up can take place in this operating mode, for example. This can also be the operating mode, for example, during operation when the UV module 1 is operating at low output, for example, in particular when the glass tube temperature is low, for example when the emitter output is less than 140 to 120 W/cm.

Figure 5:
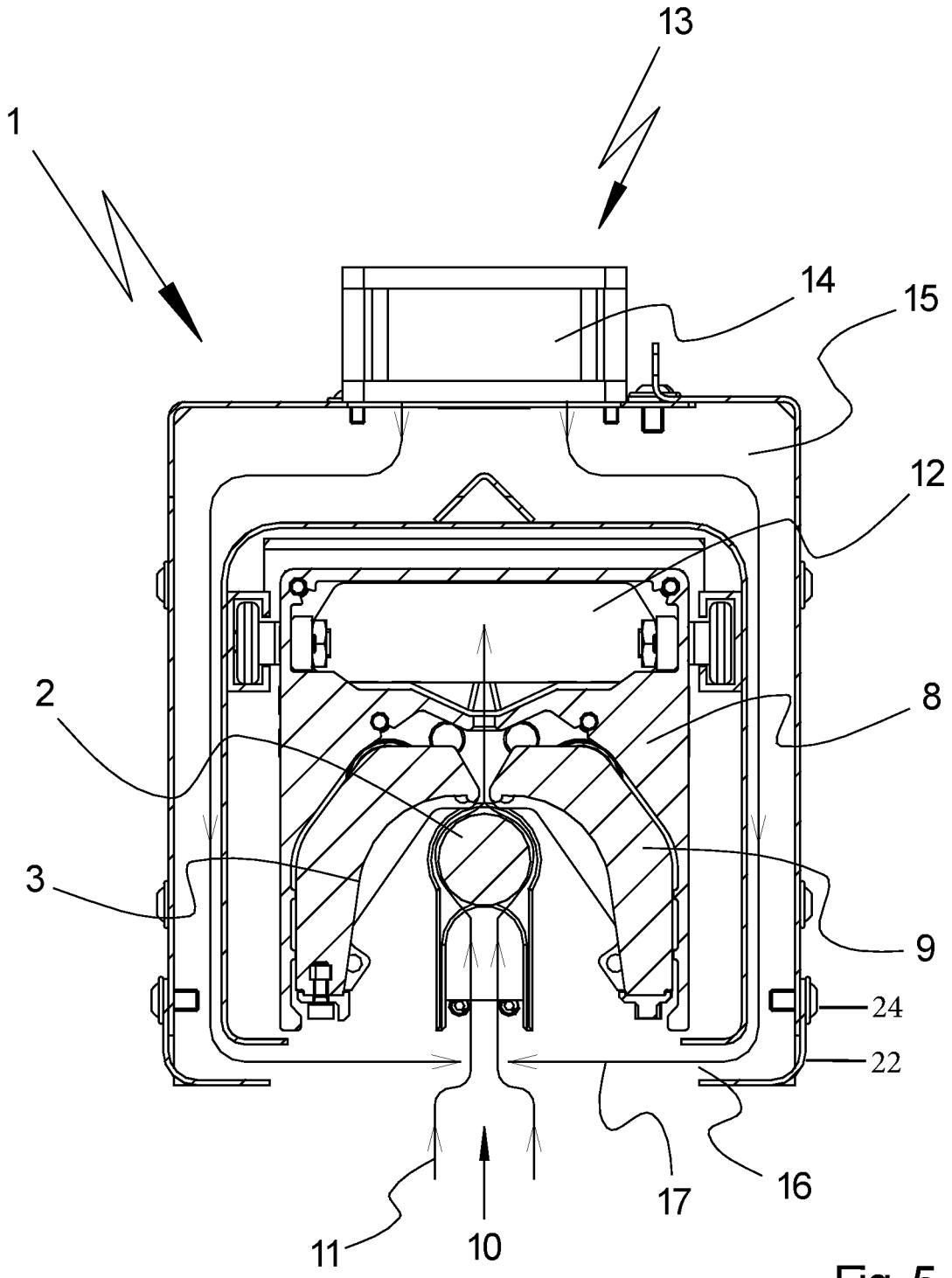
FIG. 5: a cross section of the UV module with the blower air system activated.
Figure 6:
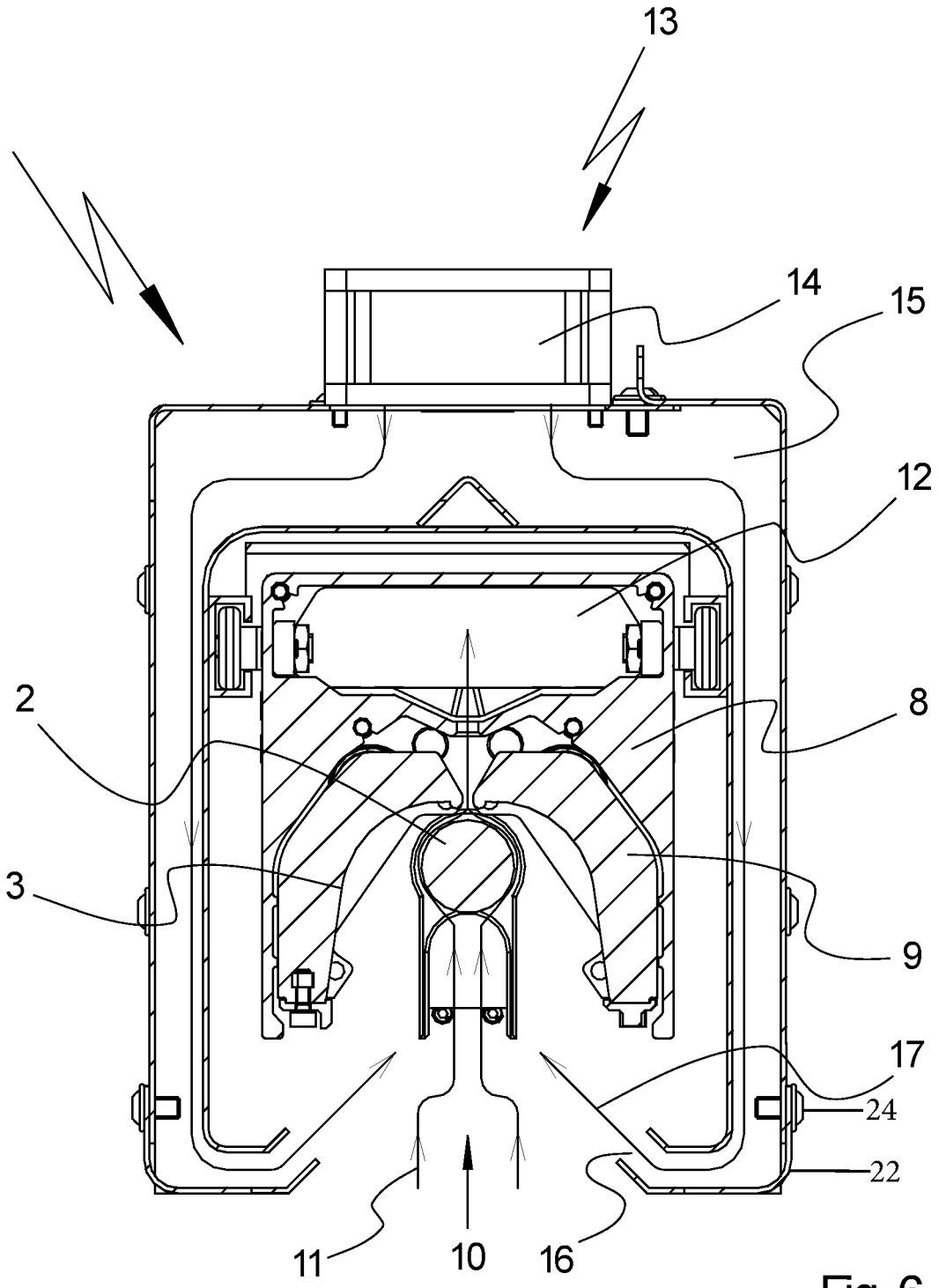
FIG. 6: a cross section of the UV module with an alternative blower air system activated.

FIG. 5 shows the cross section of the UV module 1 with the blower air system 13 activated, here in particular the add-on blower air system 13. One or more fans, here in particular axial fans 14, are used to generate an air flow in air ducts 15 to the air inlet opening 10 that faces the processing material or printing material. At least approximately orthogonally to the ambient air flow 11 flowing in through the air inlet opening 10, a blower air jet 17 is preferably generated on each of the two sides of the air inlet opening 10 through blower air openings 16. The blower air jets 17 can each be formed by individual blower air openings 16 or by continuous slot-shaped nozzles, which extend, for example, over the length of the radiation source, in particular at least between electrodes 19 of a UV emitter 2. In particular, cooling outside of the electrodes 19 of a mercury vapor lamp is reduced or eliminated so that excessive cooling is avoided. In a further refinement, the gap formed by the blower air openings 16 can also be embodied as adjustable by the provision of suitable gap adjustment members 22 whose positions are adjustable by sheet metal screws 24, as seen in FIGS. 4, 5 and 6, so that, for example, an adjustment in the gap formed by the blower air openings 16 for performance classes and/or an adaptation to installation spaces or machines may be made. Preferably, a gap that is opened through the blower air openings 16, measuring 1 mm to 10 mm, particularly preferably 2 mm to 6 mm, and very particularly preferably at least approximately 4 mm, is preferably set.

The blower air jets 17 generated by the blower air system 13 are aligned toward one another in one plane, in particular such that they influence, in particular restrict or constrict, the ambient air flow 11 flowing into the housing profile 8. The blower air jets 17 are preferably directed toward one another in one plane in such a way that they would preferably meet at the center of the air inlet opening 10, for example exactly below the UV emitter 2. The ambient air flow 11 is preferably influenced in such a way that the ambient air flow 11 cools the underside of the UV emitter 2, which faces the processing material or printing material, with increased intensity. In particular, the blower air system 13 generates a cross flow to the ambient air flow 11.

FIG. 6 shows a UV module 1 with an alternative blower air system 13, which can likewise be added on, for example. The blower air system 13 likewise has one or more fans, in particular axial fans 14, which generate an air flow flowing in air ducts 15 to the air inlet opening 10 that faces the substrate or printing material. Here, the blower air system 13 has blower air openings 16, however instead of blowing directly onto the UV emitter 2, they restrict or constrict the inflowing ambient air flow 11 beneath the UV emitter 2 or even before said air flow reaches the UV emitter 2. Since the air ducts 15 or blower air openings 16 can be seated at least partially in the beam path of the UV emitter 2, they can also be made of a radiation-permeable material.

Figure 7:
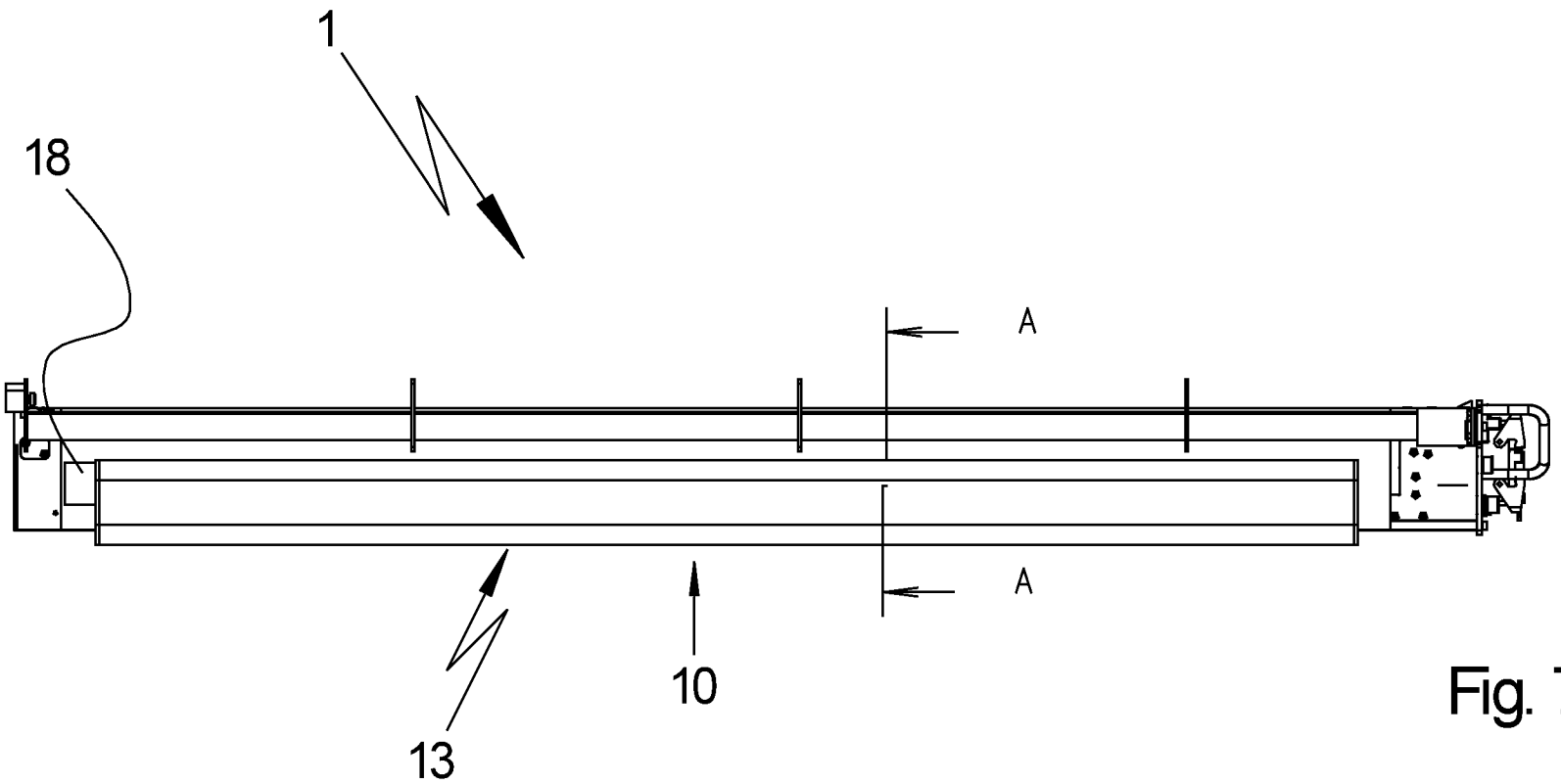
FIG. 7: a UV module of a dryer having a longitudinally extending UV emitter and an associated alternative blower air system.

FIG. 7 shows a UV module 1 having a longitudinally extending UV emitter 2 and an associated alternative blower air system 13. Rather than a separate air generator, the blower air system 13 has at least one compressed air connection 18, air ducts 15, and one or more blower air openings 16. In particular, at least one compressed air connection 18 is associated with each air duct 15 that extends transversely to the conveying direction of the processing material, and said compressed air connection pressurizes the respective air duct 15 with a pressure higher than the ambient pressure. The overpressure can develop in the air duct 15 over the format width and can emerge via the blower air openings 16 as a blower air jet 17.

Figure 8:
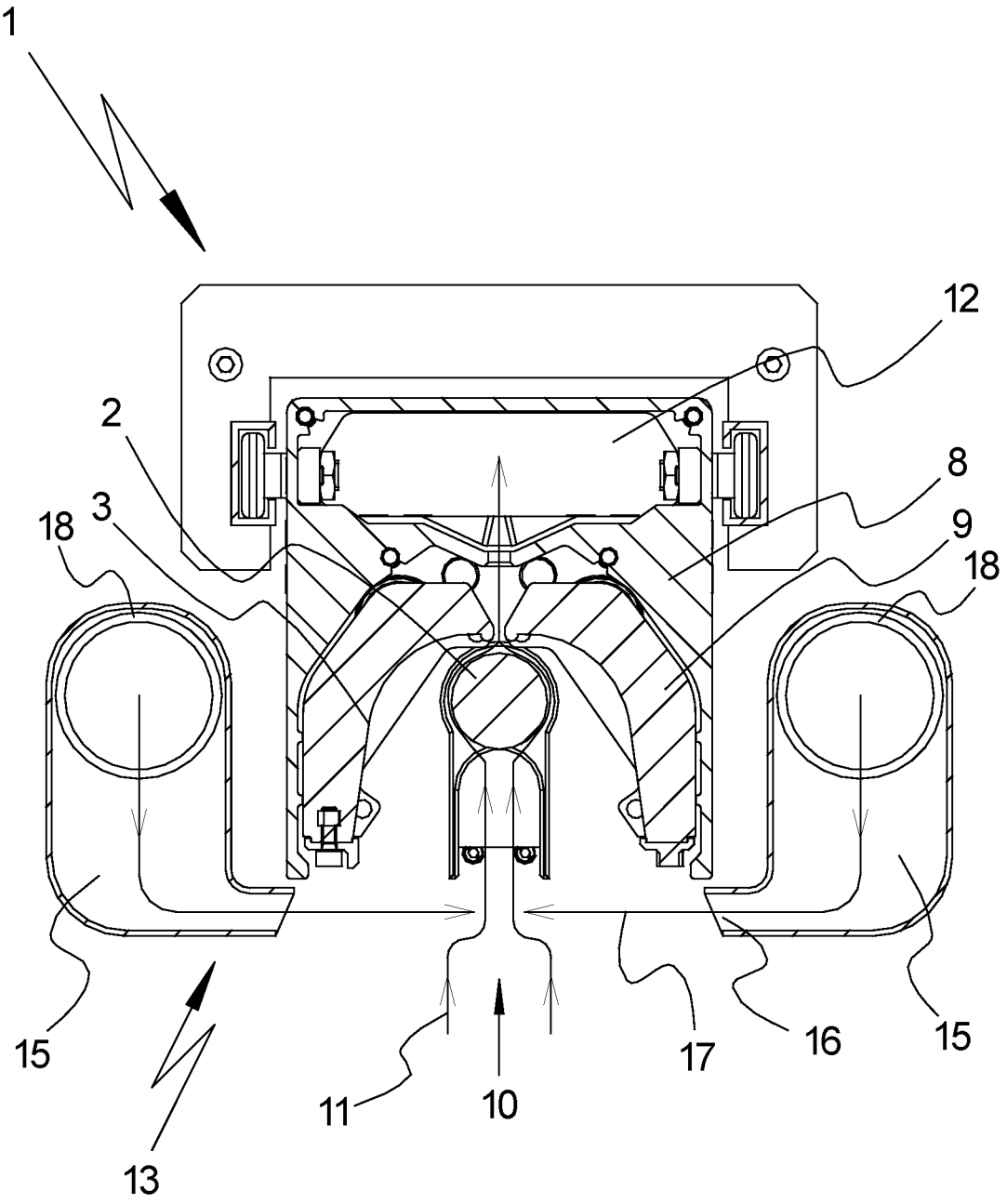
FIG. 8: a cross section of the UV module having an alternative blower air system.

FIG. 8 shows the cross section of the UV module 1 according to section A-A of the preceding figure with the alternative blower air system 13. The compressed air supplied via the respective compressed air connection 18 is distributed over the respective air duct 15 and emerges, directed via the blower air openings 16, in the region of the air inlet opening 10 of the UV module 1. The blower air jets 17 can be generated by respective individual blower air openings 16 or by respective continuous slot-shaped nozzles, which extend, for example, across the width of the processing material or printing material. In that case, the blower air jets 17 are aligned toward one another in one plane, in particular in such a way that they influence, in particular restrict or constrict, the ambient air flow 11 flowing into the housing profile 8. Preferably, the ambient air flow 11 is influenced similarly, such that the ambient air flow 11 cools the underside of the UV emitter 2, which faces the processing material or printing material, with increased intensity.

Figure 9:
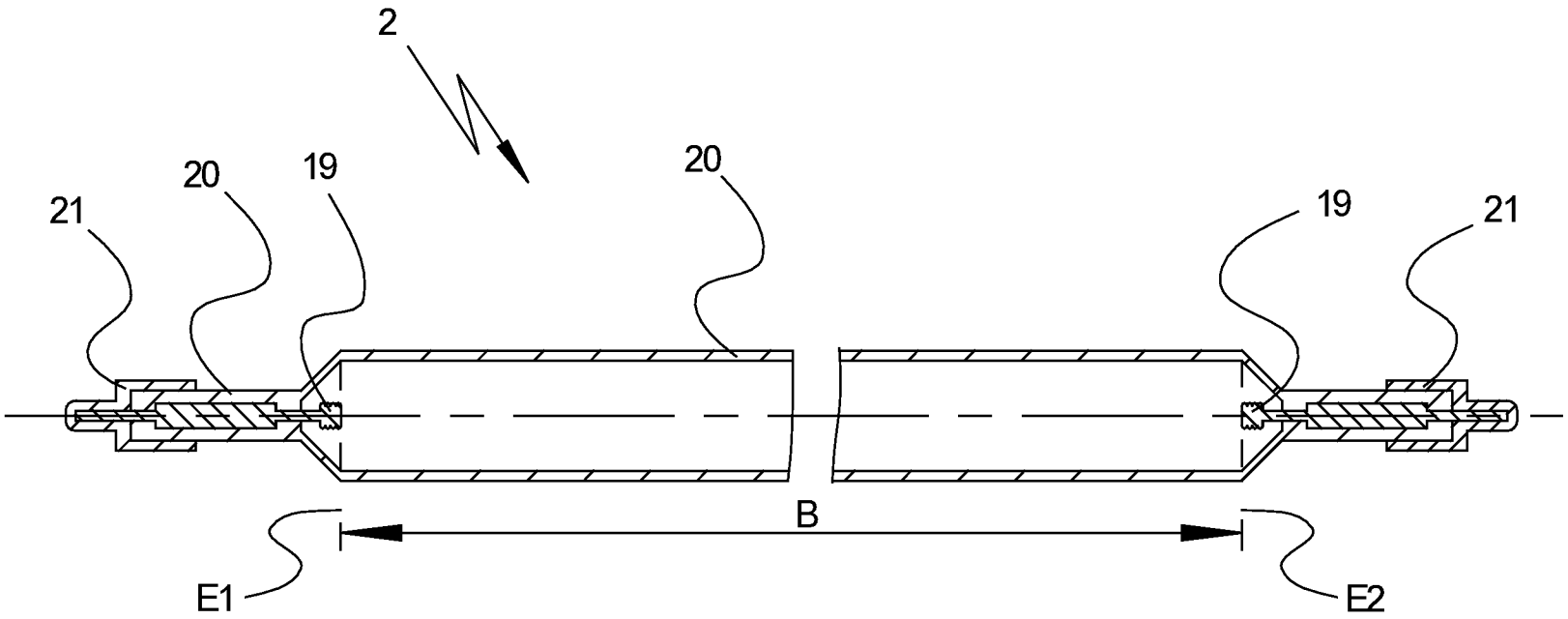
FIG. 9: an elongated UV emitter having a cooling system that operates exclusively between electrodes.

FIG. 9 shows an elongated UV emitter 2 embodied by way of example as a mercury vapor lamp, having a cooling system or blower air system 13 that operates exclusively between electrodes 19. The UV emitter 2, which is configured, for example, as a medium-pressure mercury vapor lamp, comprises the two electrodes 19, each arranged at one end of a glass body 20 and each contacted or energized via a pin 21. The electrodes 19 can be activated, for example, by an integrated or external pilot control device. Each of the two spaced-apart electrodes 19 lies at least partially in a plane E1, E2 that is intersected by the elongated UV emitter 2, for example the mercury vapor lamp, as an idealized common normal (as an orthogonal vector). Said planes E1, E2 are to be understood as idealized parallel planes in space that are spaced apart from one another, wherein the surfaces of the electrodes 19 at least touch the planes E1, E2. A cooling region B of the cooling system or blower air system 13 is located, in particular, exclusively between the mutually facing electrode surfaces that span the planes E1, E2. The cooling region B of the cooling system or blower air system 13 that has a maximum cooling capacity is preferably formed or bounded here by the two planes E1, E2.

The cooling system or blower air system 13 of the radiation source, in particular of the UV emitter 2, has a maximum cooling capacity here exclusively in a cooling region B between the planes E1, E2 formed by the electrodes 19. A constant cooling output is preferably generated over the entire cooling region B, the cooling region B particularly preferably extending only between the mutually facing surfaces of the electrodes 19. However, the maximum cooling output in the cooling region B can be controlled or adjusted in terms of intensity or effect according to desired requirements. Adjacent to the cooling region B, in particular outside of the planes E1, E2, the cooling output of the cooling system or the blower air system 13 is reduced as compared with the maximum cooling capacity, or preferably is zero. The diameter of the glass body 20 in the present case is larger between the planes E1, E2 or in the cooling region B than in the edge regions. Outside of the planes E1, E2, the glass body 20, which surrounds the electrodes 19, tapers, with the tapered ends of the glass body 20 in particular bearing the pins 21 for establishing electrical contact with the electrodes 19. Physically, therefore, the electrodes 19 preferably lie largely outside of the cooling region B of the cooling system or blower air system 13. This embodiment is particularly preferably used in medium-format machines, such as sheet-fed printing presses. Medium format machines can be used to process processing material measuring at least approximately 1 m in width, for example.

Figure 10:
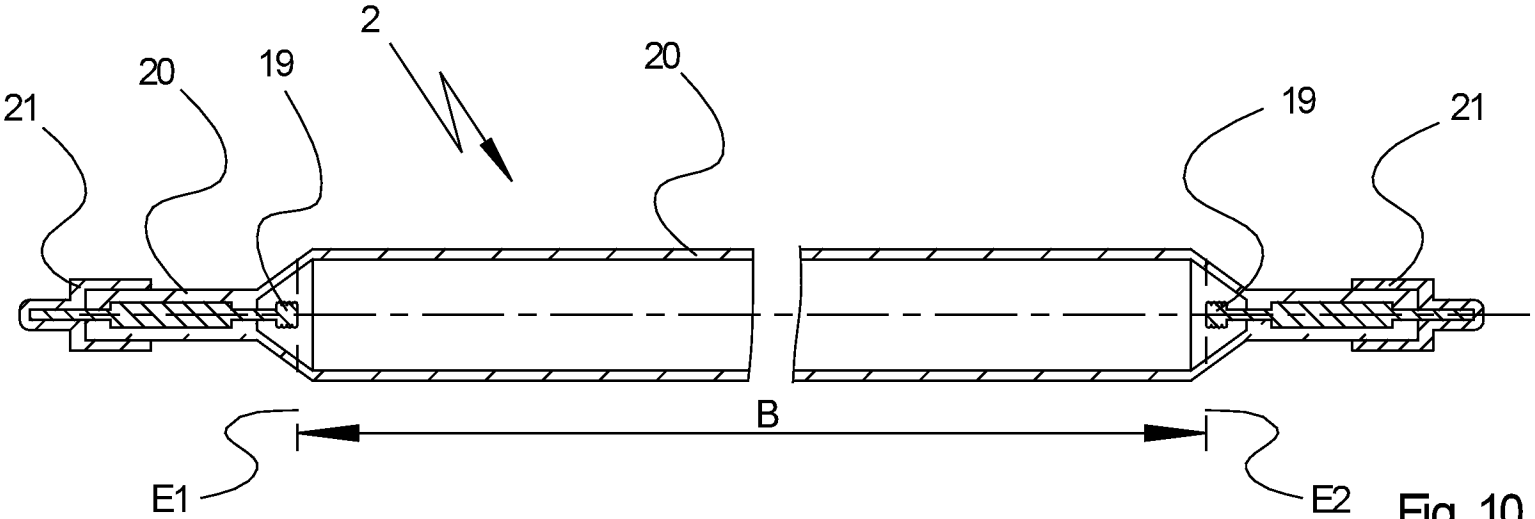
FIG. 10: an elongated UV emitter for large format machines.

FIG. 10 shows an alternative elongated UV emitter 2 that is suitable in particular for use in large-format machines. Large-format machines, such as sheet-fed printing presses, can process processing material, for example, having a width of more than 1 m, for example approximately 1.4 m or 1.6 m or even more. The UV emitter 2 is characterized in that the planes E1, E2 intersect the tapered regions of the glass body 20. Thus the glass body 20 first reaches its maximum diameter within the cooling region B bounded by the planes E1, E2. This prevents the ambient air that flows in laterally from cooling the electrodes 19 excessively, especially when shutters 9 are closed. Excessive cooling when the shutters 9 are closed, for example when the machine is idle or printing is interrupted or paused, would cause the UV emitter 2 to blow out. The special shape of the glass body 20, in particular in conjunction with the correspondingly dimensioned cooling region B, enables the functionality of the UV emitter 2 to be ensured both when the shutters 9 are open and when they are closed.

Figure 11:
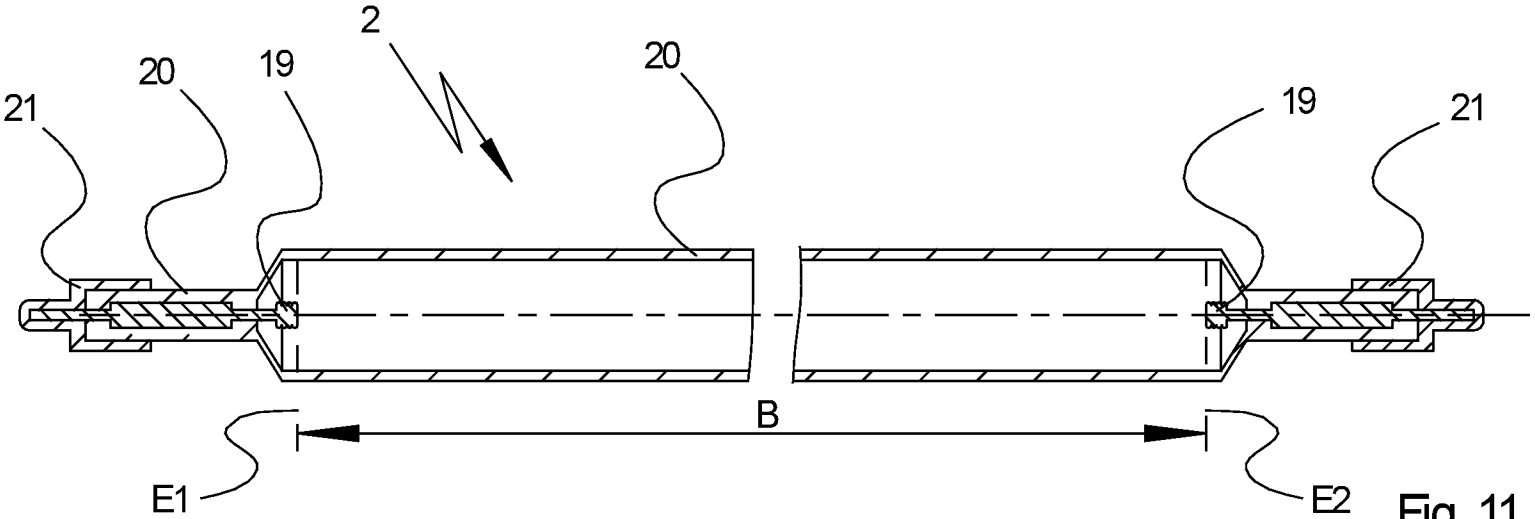
FIG. 11: an alternative embodiment of a UV emitter.

FIG. 11 shows an alternative embodiment of a UV emitter 2. The glass body 20 tapers only outside of the planes E1, E2. The planes E1, E2 thus intersect the glass body 20 in the region of its maximum diameter. However, in this case as well the planes E1, E2 that delimit the cooling region B of the cooling system or blower air system 13 are spanned by the mutually facing surfaces of the electrodes 19 of the UV emitter 2.

Regarding the mode of operation: In order for the radiation source, in particular a UV emitter 2, to also be cooled well on its underside, air is preferably blown in on both sides, in particular beyond the irradiation range of the UV module 1. This air preferably meets at the center beneath the UV module 1, in particular approximately at the center of the UV emitter 2. The inflowing ambient air constricted by the blower air jets 17 in the UV module 1 is transported to the underside of the UV emitter 2. In this way, the underside of the UV emitter 2 is intensely cooled. Furthermore, cooling becomes more turbulent overall and the upper side of the UV emitter 2 is also cooled better. WALTER The additional air is preferably introduced or blown in exclusively between electrodes 19 of the UV emitter 2 or over the length of the UV module 1. This can be accomplished by means of plates and/or blower air nozzles.

The air that is preferably introduced or blown in on both sides can be either a partial volume or at least nearly all of the cooling air acting in the UV module 1. Preferably, however, 80% to 50% of the cooling air is formed by the inflowing ambient air flow 11, and 20% to 50% of the cooling air is formed by the air introduced by the blower air system 13. In particular, a proportion of 1/3 of the air or blower air 17 that is additionally introduced by the blower air system 13, and a proportion of 2/3 of the inflowing ambient air flow 11 is sought.

For example, the UV emitter 2 can be operated at an output of between approx. 80 W/cm and approx. 200 W/cm. The blower air system 13 can also be activated or switched on dependent on the output. In particular, the blower air system 13 can be activated only after it reaches an average output, for example at approximately 120 to 140 W/cm. In that case, the blower air system 13 can be fully inactive or can be fully deactivated below an emitter output of, for example, 120 to 140 W/cm. For example, the blower air system 13 can be activated as soon as it reaches 120 to 140 W/cm. Preferably, the effect of the blower air system 13 can be increased as the emitter output increases. In particular, the blower air system 13 can begin to operate as soon as an emitter output of 120 to 140 W/cm is reached and can preferably be increased linearly or in a functionally dependent manner up to a maximum emitter output of 200 W/cm, so that at an emitter output of 200 W/cm, the blower air system 13 is operating at 100% output.

In the case of functionally dependent control, the blower air can be adjusted in particular according to a set of characteristics, which can have local maxima and/or minima, for example. In that case, the blower air can be adjusted on the basis of a curve established, for example, between 120 W/cm and 200 W/cm. A function for operating the blower air system 13 can be specified and/or modified based on the emitter output, in particular dependent on the machine. However, the effect of the blower air system 13 can also be adjusted individually and/or can also be embodied as controlled or regulated, for example, according to the emitter output. In that case, the current emitter output can be known to a control device, in particular the machine controller, or can be determined by a sensor system. By reducing the effect of the blower air system 13 or by switching off the blower air system 13 at a low emitter output, for example below 140 W/cm, a blow-out of the UV emitter 2 is reliably prevented.

While a preferred embodiment of a processing machine having a radiation dryer and a method for operating such a dryer is disclosed fully and completely hereinabove, it will be apparent to one of skill in the art that various changes can be made thereto, without departing from the true spirit and scope of the present invention, which is accordingly to be limited only by the appended claims.

The invention claimed is:

1. A processing machine having a drying device,
wherein the drying device comprises a radiation source accommodated in a housing,
wherein shutters are provided adjacent to the radiation source in the housing,
wherein the housing has at least one air inlet opening for ambient air, whereby, once the ambient air has entered the at least one air inlet opening in the housing, it flows around the radiation source,
wherein the housing has an air outlet opening for exhaust air,
wherein a blower air system, which generates at least one blower air jet, is associated with the drying device, and by the use of which blower air system, the at least one blower air jet from the blower air system and the ambient air flowing into the air inlet opening in the housing and around the radiation source are actively directed, at a distance from the radiation source and, wherein the blower air system has at least one blower air flow opening that expels a flow of the at least one blower air jet least approximately orthogonally to the direction of flow of the ambient air flowing into the air inlet opening in the housing.

2. The processing machine according to claim 1, wherein the radiation source is configured as an elongated UV emitter having first and second electrodes lying spaced apart from one another, each of the first and second electrodes lying in one plane, wherein the elongated UV emitter is arranged as a normal to the planes of the first and second electrodes, and wherein the blower air system generates the flow of the at least one blower air jet in a region that one of lies between the planes and is bounded by the planes.

3. The processing machine according to claim 1, wherein the blower air system has at least two opposing ones of the blower air flow openings, which at least two opposing ones of the blower air flow openings are arranged adjacent to the air inlet opening in the housing.

4. The processing machine according to claim 1, wherein the blower air system has one or more of the blower air flow openings arranged outside of the air inlet opening in the housing.

5. The processing machine according to claim 1, one of wherein the blower air system comprises one of a compressed air connection and at least one air generator, including an axial fan, a plurality air ducts, and a plurality of the blower air flow openings, and wherein the air outlet opening is an exhaust air duct in the housing, which exhaust air duct in the housing is connected to a suction air source and has one or more openings to a space surrounding the radiation source.

6. The processing machine according to claim 1, one of wherein the drying device comprises a UV module and wherein the blower air system is configured as one of an add-on module to be added on to a UV module and as an auxiliary module for a UV module.

7. The processing machine according to claim 1, wherein the blower air system has a plurality of the blower air flow openings, an opening gap of each of which blower air flow openings is adjustable, between 1 mm and 10 mm.

8. The processing machine according to claim 1, wherein the blower air system is controllable by a control device based on a current emitter output of the radiation source.

9. A method for operating a drying device in a processing machine,
wherein the drying device comprises a radiation source extending inside a housing,
wherein the radiation source cooperates with shutters,
wherein the housing has at least one air inlet opening for ambient air, whereby, once the ambient air has entered the housing through the at least one air inlet opening, it flows around the radiation source, and
wherein the housing has at least one air outlet opening to exhaust the ambient air entering the housing and flowing around the radiation source,
wherein a blower air system is associated with the drying device and actively deflects the ambient air flowing into the housing through the air inlet opening before the ambient air reaches the radiation source and wherein the blower air system one of directs a blower air flow and expels blower air, which blower air flow one of restricts and constricts the ambient air flowing into the housing through the air inlet opening in the housing.

10. The method according to claim 9, wherein the blower air system one of directs the blower air flow and expels blower air, which, together with the inflowing ambient air, forms cooling air for the radiation source, and subsequently forms exhaust air, wherein a proportion of a volume of the blower air flow introduced into the housing by the blower air system is one of between 20% and 50% a common cooling air flow volume and is at least approximately 33% of a common cooling air flow volume.

11. The method according to claim 9, wherein the blower air system is one of switched on and is switched off based on an output of the radiation source.

12. The method according to claim 9, wherein the blower air system one of is switched on when an emitter output of at least approximately 120 to 140 W/cm is reached and is switched off when the emitter output drops below at least approximately 120 to 140 W/cm.

13. The method according to claim 9, one of wherein the blower air system is operated whereby an effect of the blower air system increases one of linearly and in a functionally dependent manner, up to a maximum output of the blower air system, based on the emitter output, and wherein, at an emitter output of at least approximately 200 W/cm, the effect of the blower air system is at 100%.

* * * * *